US006236710B1

(12) United States Patent
Wittry

(10) Patent No.: US 6,236,710 B1
(45) Date of Patent: May 22, 2001

(54) CURVED CRYSTAL X-RAY OPTICAL DEVICE AND METHOD OF FABRICATION

(76) Inventor: David B. Wittry, 1036 S. Madison Ave., Pasadena, CA (US) 91106

( * ) Notice: Subject to any disclaimer, the term of this patent is extended or adjusted under 35 U.S.C. 154(b) by 0 days.

(21) Appl. No.: 09/250,038

(22) Filed: Feb. 12, 1999

(51) Int. Cl.[7] ..... G21K 1/06
(52) U.S. Cl. ..... 378/84; 378/82
(58) Field of Search ..... 378/49, 73, 82, 378/83, 84, 85; 425/409, 410, 411

(56) References Cited

U.S. PATENT DOCUMENTS

| | | | | |
|---|---|---|---|---|
| 4,599,741 | * | 7/1986 | Wittry | 378/84 |
| 4,649,557 | * | 3/1987 | Hornstra et al. | 378/84 |
| 4,780,899 | | 10/1988 | Adema et al. | 378/84 |
| 4,807,268 | | 2/1989 | Wittry | 378/84 |
| 4,882,780 | * | 11/1989 | Wittry | 378/84 |
| 4,949,367 | | 8/1990 | Huizing et al. | 378/84 |

OTHER PUBLICATIONS

U.S. application No. 09/149,690, Wittry, filed Sep. 8, 1998.
"Microprobe X–Ray Fluorescence With the Use of Point Focusing Diffractors" Z. W. Chen and D. B. Wittry, Appl. Phys. Lett. 71 (Sep. 29, 1997) pp. 1884–1886.
"Microanalysis by Monochromatic Microprobe X–Ray Fluorescence . . . " Z. W. Chen and D. B. Wittry, J. Appl. Phys. 84 (Jul. 15, 1998) pp. 1064–1073.

* cited by examiner

*Primary Examiner*—Robert H. Kim
*Assistant Examiner*—Drew A. Dunn

(57) ABSTRACT

A curved crystal x-ray optical device consists of a doubly curved crystal lamella attached by a thick bonding layer to a backing plate that provides for prepositioning it in three dimensions relative to a source and image position in x-ray spectrometers, monochromators and point-focussing x-ray focusing instruments. The bonding layer has the property of passing from a state of low viscosity to high viscosity by polymerization or by a temperature change. In fabrication, the crystal lamella is bent so that its atomic planes are curved to a radius of $2R_1$ in a first plane where $R_1$ is the radius of a focal circle and $R_2$ in a second plane perpendicular to the first plane by forcing it to conform to the surface of a doubly curved convex mold using pressure produced in the highly viscous bonding material by force applied to the backing plate.

25 Claims, 5 Drawing Sheets

CURVED CRYSTAL X-RAY OPTICAL DEVICE AND METHOD OF FABRICATION

BACKGROUND—FIELD OF THE INVENTION

This invention relates to devices having a doubly curved crystal for the diffraction of x-rays in spectrometers or instruments for microanalysis and also relates to a method of fabricating such crystal devices with high quality.

BACKGROUND—PRIOR ART

Doubly curved crystals are known to be useful as a means of focusing monochromatic x-rays or as a wavelength dispersive device in x-ray spectrometers. For example: (1) a toroidally curved crystal can provide point-to-point focussing of monochromatic x-rays, (2)crystals curved to spherical or ellipsoidal shape can be used as dispersive devices for parallel detection of x-rays, and (3) crystals with atomic planes spherically curved and the surface toroidally curved can provide high collection efficiency when used in scanning x-ray monochromators as described in U.S. Pat. No. 4,882,780.

Some of the prior art for doubly curved crystals and their mounting are described in U.S. Pat. Nos. 4,807,268, 4,780,899 and 4,949,367. U.S. Pat. No. 4,807,268 describes a "Wittry geometry" curved crystal formed by plastic deformation at elevated temperature. The crystals so made have low reflection efficiency and can not focus to a high degree of accuracy because of the increase of the crystal's rocking curve width due to the plastic deformation. Subsequent work has shown that in order to preserve a crystal's narrow rocking curve width, elastic, not plastic deformation must be used.

U.S. Pat. No. 4,807,268 describes a curved crystal for scanning monochromators formed by plastic deformation at elevated temperature and having unique spherically curved planes and toroidally curved surface (this has sometimes been called the "Wittry geometry" after it's inventor). These devices have a serious drawback, namely the smoothness of the crystal surface and crystal planes is strongly affected by irregularities in the bonding layer. The irregularities can result from the lack of uniform initial thickness of the adhesive layer on the substrate or it can occur during mounting of the crystal even if the initial adhesive layer is highly uniform. In addition, the use of a precision concave substrate is disadvantageous because a new substrate which must be made with great precision and expense is required for each new crystal device.

OBJECTIVES OF THE PRESENT INVENTION

The objectives of the invention are as follows: (1) to provide an x-ray crystal device which can be fabricated so that the crystal is doubly curved with a smoother surface and smoother crystal planes than is obtained by other methods of fabrication, 2) to provide an x-ray crystal device whose planes are more accurately curved to a predetermined theoretically-optimum shape, (3) to obtain smaller focal spot sizes when the crystal device is used for focusing x-rays than the spot sizes previously obtained, (4) to provide a method of fabrication that will allow the fabrication of many identical crystal diffracting devices by use of only one mold, and (5) to provide a crystal device that can be aligned for use with a minimum of adjustments, and (6) to provide a crystal device which, when used in x-ray instruments, can be readily removed and replaced with minimal requirement for realignment.

BRIEF DESCRIPTION OF THE INVENTION

This invention achieves some of the desired objectives by bonding the crystal to its substrate by a thick bonding agent that has high viscosity in it's initial state and hardens to a solid in its final state. The crystal is bent to its final state by bending it to conform to a convex mold that has the desired shape of the surface of the crystal using pressure that is applied to the crystal by the viscous bonding agent which receives pressure from a force applied to the backing plate during fabrication. Additional features of the invention include special configurations of the mold containing the surface used for bending, and special characteristics of the crystal and backing plate that make the crystal device more convenient to use and easier to align.

DETAILED DESCRIPTION OF THE INVENTION

Figure 1:
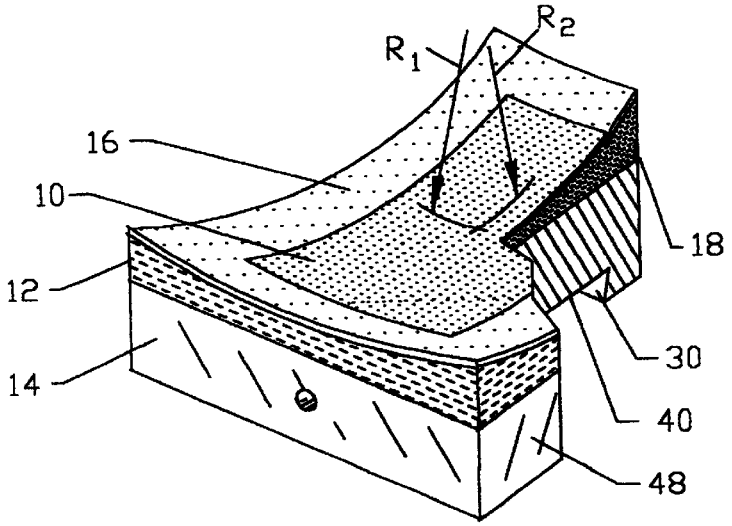
FIG. 1 shows a simple form of the invention, for example: with a crystal, a thin plastic separator sheet, a thick bonding layer and a flat backing plate

An x-ray crystal device as shown in FIG. 1 consists of a thin doubly curved crystal lamella 10, a thick bonding layer 12, and a backing plate 14. In this device, the bonding layer 12 having a thickness typically 10 to 50 times the thickness of the crystal constrains and holds the crystal to a preselected geometry. The crystal can be one of a number of crystals used in x-ray diffraction, such as mica, silicon, germanium, quartz, etc. The bonding layer consists of a material that has a high viscosity in its initial state and can be transformed by polymerization, or by a temperature change to a solid. Suitable bonding materials are thermoplastic resins, various thermosetting resins, epoxy, low melting point glass, wax, etc. The most important property of the bonding layer is a viscosity of the order of $10^8$–$10^8$ Poise (c.g.s. units) before it reaches its final state. A particularly useful epoxy resin called "Torr Seal" is used in one preferred embodiment of the invention. This initially has a paste-like consistency, a viscosity of the order of $10^3$ Poise, and a pot life of 30–60 minutes. Furthermore, the low vapor pressure of this material in its cured state is desirable if the crystal device is used in a vacuum environment. Other paste types of epoxy that could be used include "plumber's epoxy" and "Milliput" epoxy putty which have physical properties similar to Torr Seal except for the low vapor pressure.

A thin plastic separator sheet 16 between a portion of the surface of the crystal near its edges lies between the crystal 10 and the bonding layer 12. This plastic separator extends 1–3 mm beyond the crystal's edges in order to prevent the bonding material from sticking to the mold or flowing under the crystal during fabrication. Thin plastic strip with pressure sensitive adhesive coating such as "Scotch tape" or "transparent mending tape" which have a thickness of typically 0.05 mm have been successfully used for the said plastic sheet with the adhesive side facing the crystal. Somewhat thinner or thicker plastic sheets could also be used.

Figure 2:
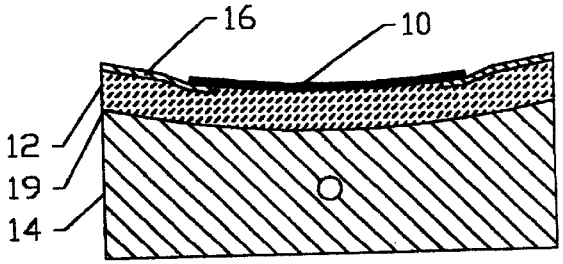
FIG. 2 shows a vertical section of a crystal device similar to the one shown in FIG. 1 with no plastic separator sheet and a backing plate with a concave bonding surface having a shape similar to the surface of the mold used for bending.

The plastic separator sheet is omitted in an alternative form of the invention shown in FIG. 2. This form of the invention is simpler than the structure shown in FIG. 1 and is feasible if the epoxy has a sufficiently high viscosity that it cannot flow under the crystal lamella. In this case, the bonding layer 12' does not extend as far beyond the crystal lamella 10', in order to minimize it sticking on the mold.

The backing plate 14 in FIG. 1 and 14' in FIG. 2 is selected of a material to which the bonding material adheres, which is dimensionally stable, and which has a coefficient of thermal expansion similar to the crystal. If the crystal to be used is transparent to light (e.g. quartz, alkali halides, etc.) it is desirable to use a transparent material for the backing plate and the bonding material so that optical interferometry can provide a means for quality control. The backing plate can be flat as indicated by reference no. 18 in FIG. 1, or it can have a concave surface as indicated by 19 in FIG. 2. The exact shape of the surface is usually not critical as will be seen in the fabrication method for a preferred embodiment that will be described.

It will be noted generally, it is best to use a convex mold for bending the crystals as in U.S. Pat. No. 4,807,268. This allows for the mold to be reused and for the crystal to be conformed directly to the surface of the mold without any intervening layer, yielding high accuracy. In most cases, it is important that the crystal be properly located relative to the mold both in position and in angular orientation. This can be done by using a mold whose size matches the crystal size and using barriers at the exact boundaries of the crystal. This approach can be used for devices like the one in FIG. 2 but is inaccurate when used with ones like FIG. 1.

Figure 3:
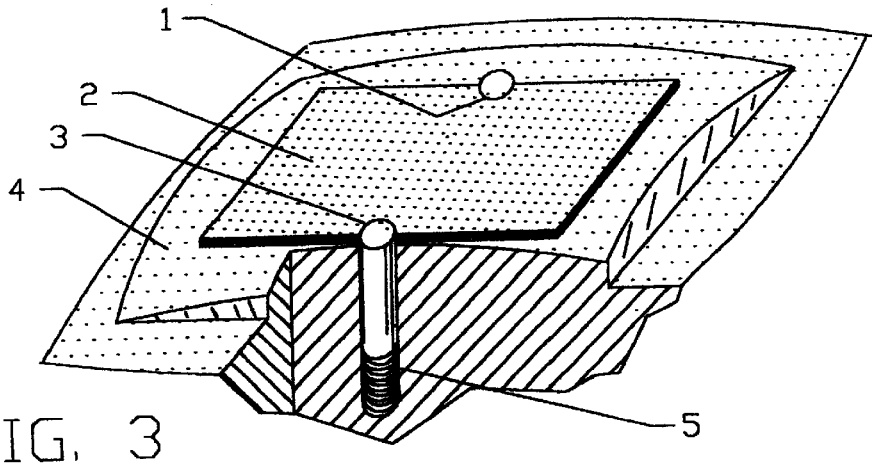
FIG. 3 shows an initial stage in fabrication of a doubly curved crystal device with provision for locating the crystal relative to the mold.

FIG. 3 shows a preferred embodiment in the present invention wherein the crystal lamella 1 has half-circle indentations 2 and 2' accurately made on two opposing faces. This may be done with a special fixture or with an ultrasonic "cookie cutter" and an abrasive slurry. The two indentations engage dowel pins 3 and 3' which slide in cylindrical cavities made in the mold 4 by drilling and reaming. Helical springs such as 5 allow the dowel pins to slide into the mold when the crystal is bent, otherwise, they are essential flush with the top surface of the crystal. This approach to positioning the crystal relative to the mold is compatible with the use of a thick viscous agent for deformation according to the following method: The fabrication method for the crystal device is shown in FIGS. 4A–4D. A convex mold 20 having a surface of the desired shape is prepared by single point machining or by a numerically controlled milling machine. Single point machining (e.g. with a diamond tool) is particularly suited to toroidal surfaces, i.e. surfaces of revolution having one radius of curvature in a plane perpendicular to the axis and a second radius in the plane passing through the axis. The mold surface 22 is polished to a mirror finish; hence, materials such as stainless steel, glass, or hard aluminum alloys may be used. A glass or transparent mold would facilitate the use of interference fringes.

After the mold is prepared (by steps that are not shown here), a crystal lamella is prepared. This lamella may be flat as shown by 11 and 13 in FIGS. 5A and 5B, or cylindrical as shown by 15 and 17 in FIGS. 5C and 5D. The thickness of the lamella is critical; it should be no more than ~1/5,000of the smallest radius of curvature. For mica, the crystal surfaces as cleaved are satisfactory, but for brittle crystals without such pronounced cleavage planes (e.g. quartz and silicon), it is important that the surface be damage free. This may be accomplished by etching or by chemical polishing after cutting and mechanical polishing.

Figure 4A:
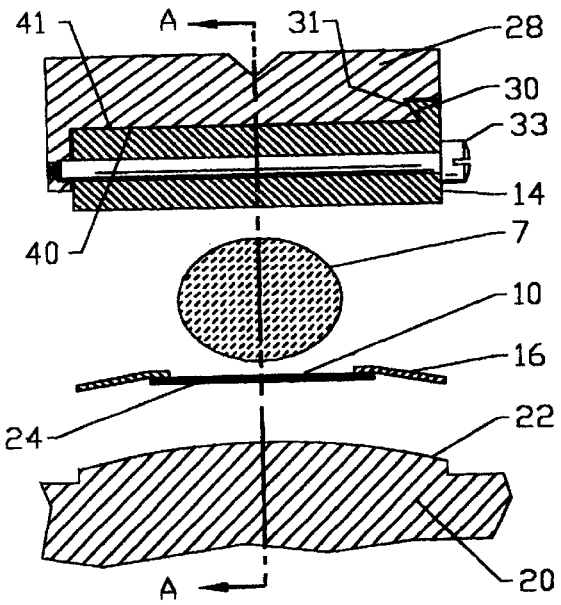
FIG. 4A shows a vertical cross section of the initial arrangement of components for fabricating of a doubly curved crystal device.
Figure 4B:
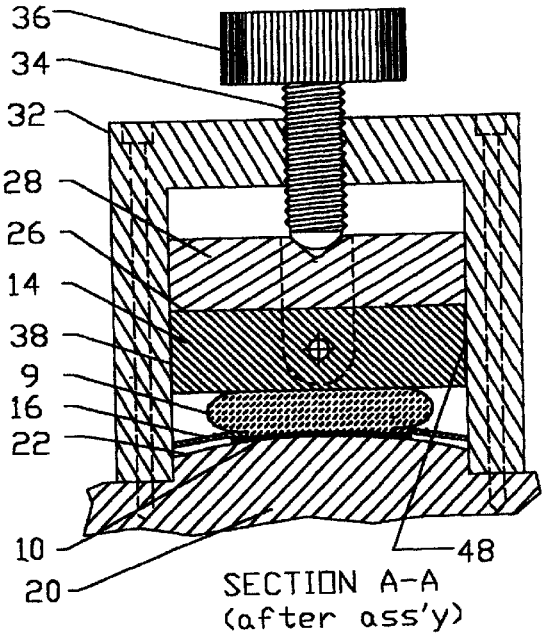
FIG. 4B shows a vertical cross section of the arrangement of components at an intermediate stage of fabrication of the doubly curved crystal device.

After the crystal lamella is prepared, the thin plastic sheet 16 is attached around the edges of crystal 10 as shown in FIG. 4A, and the crystal with plastic sheet is positioned on the convex mold 20. At this stage, it is very important to avoid the presence of dust particles, particularly between the crystal and the mold. If epoxy is used for the bonding agent, a blob of epoxy 7 is placed on top of the crystal 10. The backing plate 14 is attached to a piston 28 by means of a screw 33 which threads into part of the piston and pulls the projecting surface 30 on the back side of the backing plate against a mating surface 31 on the piston. Due to of the slope of the surface 30, the backing plate's surface 40 is pulled snugly against surface 41 of the piston. The piston has a rectangular cross section matching the backing plate and these two components are placed on top of the epoxy as shown in FIG. 4A. The assembly is mounted in the pressing fixture 32 attached to the mold as shown in FIG. 4B. The pressing fixture has a rectangular cavity in which the piston 28 and backing plate 14 are free to slide. In this way, the backing plate is indexed in position relative to the mold via the backing plates's lateral surfaces (e.g. 38 and 40). The assembly is compressed lightly by turning the knob 36 attached to screw 34 to flatten the epoxy and bring the crystal in to better contact with the surface of the mold. As the epoxy begins to polymerize, the pressure on the backing plate 14 is gradually increased by further turning of the screw 34 so as to force the crystal 10 against the mold 20 as shown in FIG. 4B.

During this process, if the backing plate and the crystal are transparent, contact between the crystal surface 24 and the mold surface 22 can be monitored by observing interference fringes with illumination by light through the surface 26 of the backing plate 14. Alternatively, such fringes can also be observed by light passing through the mold if it is transparent. Dust particles, or undesirable penetration of the bonding material between the crystal and the mold can be observed in this case, indicating that the plastic sheet 16 failed in its purpose of preventing this penetration. In addition it will be possible to observe cracking of brittle crystals if this happens to occur. However, it should be noted that as long as the pieces of the crystal remain in the proper position, cracking of the crystal will not affect the performance of the device significantly.

Figure 4C:
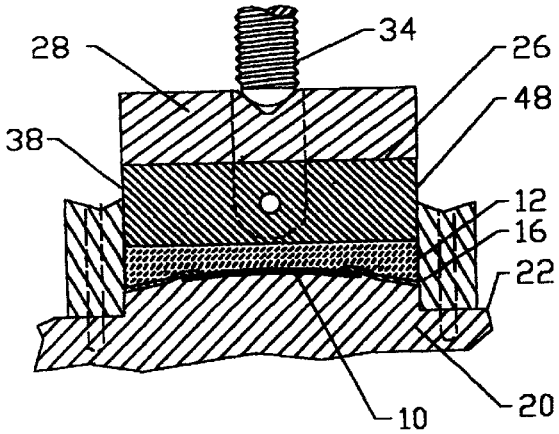
FIG. 4C shows a vertical cross section of the final configuration with the crystal bent to its final shape matching the mold.
Figure 4D:
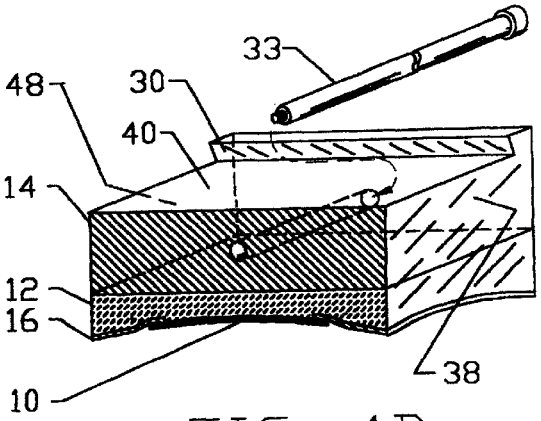
FIG. 4D shows the doubly curved crystal device after being removed from the mold.

When the epoxy completely fills the space between the backing plate and crystal with plastic strip as shown in FIG. 4C, the pressure on the backing plate is held constant until the epoxy is completely cured. Then, the device is removed from the mold, from the pressing fixture and from the piston, yielding the result shown in FIG. 4D. In this step, the plastic sheet 16 is important to prevent the bonding material 12 from sticking to the mold 20 so that removal can be accomplished without distorting the bonding material. In this connection, it should be noted that use of parting agents to prevent adhesion of the bonding material to the mold is not desirable because the presence of these agents will reduce the accuracy with which the crystal conforms to the desired shape. However, parting agents may be used to prevent the epoxy from sticking to the pressing fixture. This positioning is less critical and it is recognized that in most cases, the completed device must be aligned relative to the x-ray source after its fabrication is complete (one can only hope to get the least critical alignments correct—the others require in situ adjustments).

Figure 7A:
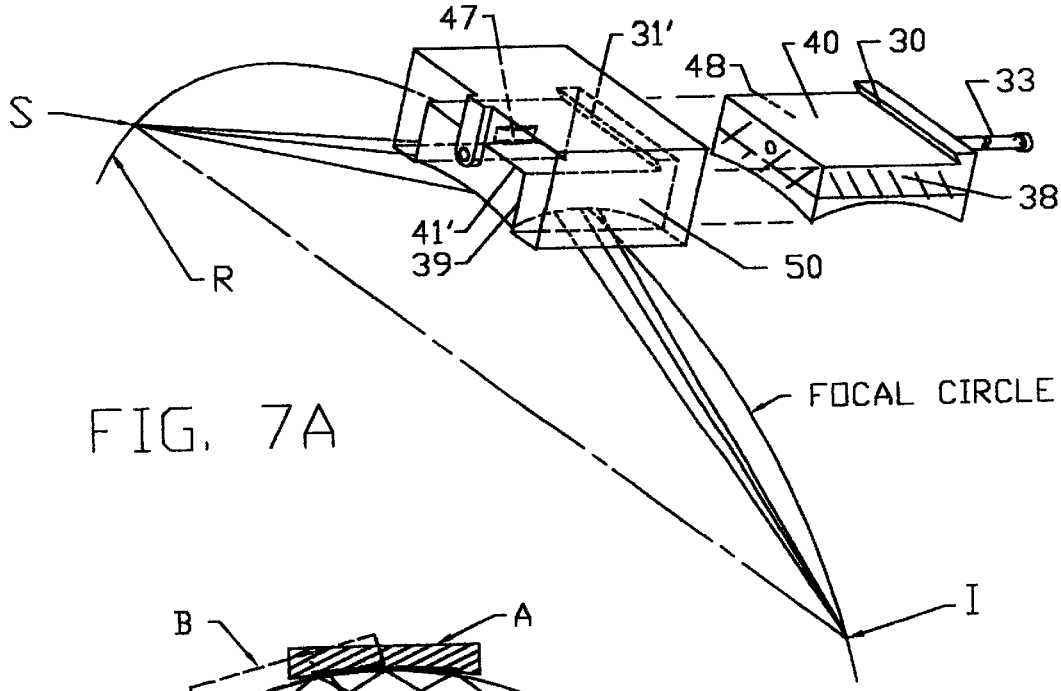
FIG. 7A shows a toroidal crystal device with the property of point-to-point focusing.

One of the most important applications of this invention is that of focusing x-rays of a particular wavelength from a source to form an x-ray microprobe. This type of device with point-to-point focusing property is illustrated in FIG. 7A. The crystal in this device has a toroidal shape such that the crystal satisfies either the Johann or Johansson geometry in the plane of the Rowland circle 28 and also has axial symmetry about the line joining the source S and the image I.

Figure 5A:
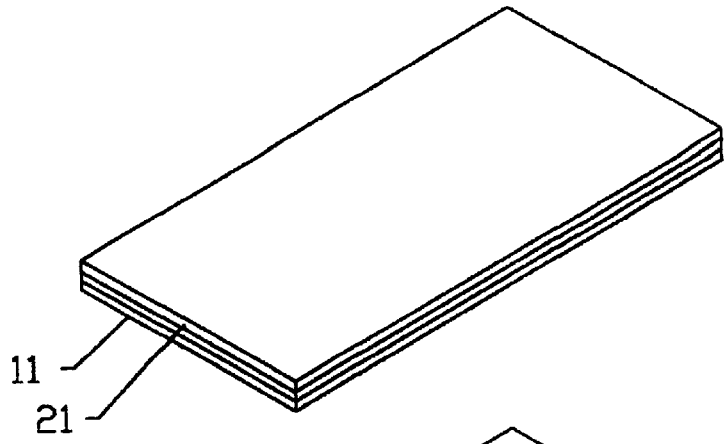
FIG. 5A shows a flat crystal lamella with atomic planes 21 parallel to the large surface of the lamella 11.
Figure 5B:
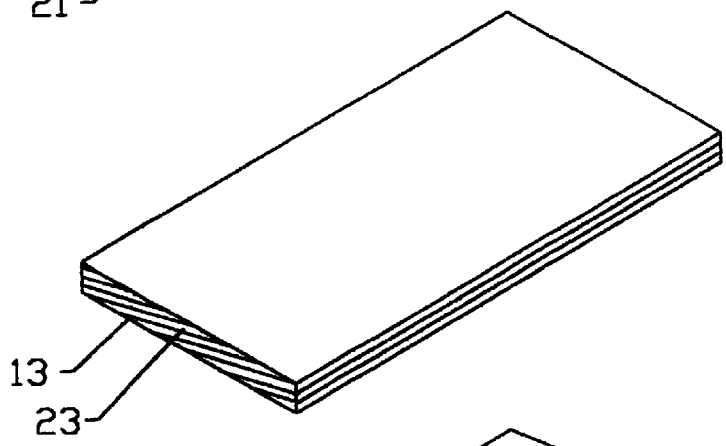
FIG. 5B shows a flat crystal lamella with atomic planes 23 making an angle with respect to the large surface of the lamella 13.
Figure 6A:
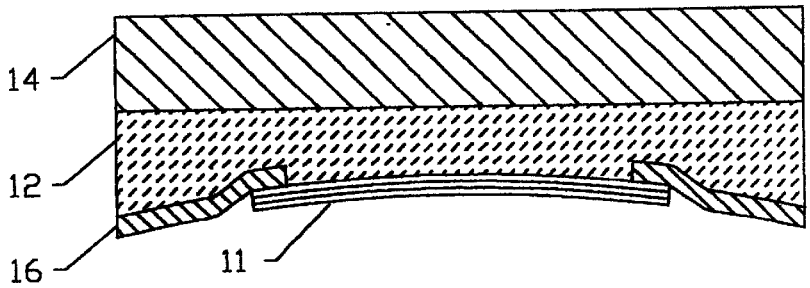
FIG. 6A shows a vertical cross section of a doubly curved crystal device made by using the crystal lamella of FIG. 5A.
Figure 6B:
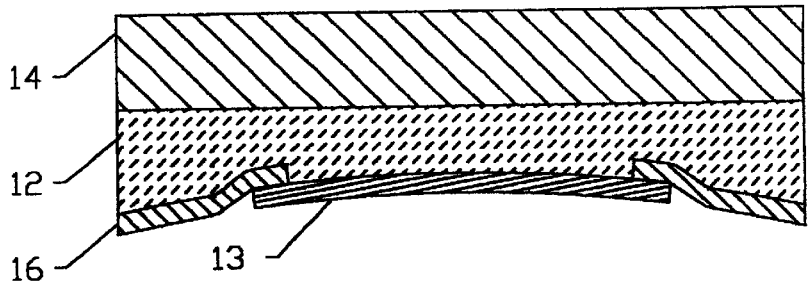
FIG. 6B shows a vertical cross section of a doubly curved crystal device made by using the crystal lamella of FIG. 5B.

If a crystal lamella like the one shown in FIG. 5A is used, having crystal planes 21 parallel to the surface 11 and the mold has a radius of $2R_1$ in the plane of the focal circle having a radius $R_1$, the result after bending will be as shown in FIG. 6A and the geometry in the plane of the focal circle after alignment will be the Johann geometry. In this case, the crystal device will be in the usual symmetric position A relative to the Source S and the Image I shown in FIG. 7B. On the other hand, if the crystal lamella of FIG. 5B is used with the crystal planes 23 making an angle with respect to the large surface 13 of the lamella, and the mold has a radius of $2R_1$ in the plane of the focal circle of radius $R_1$, the result after bending will be as shown in FIG. 6B. Then, the geometry in the plane of the focal circle after alignment with respect to the source s and the image I will be similar to the Johann geometry but with the crystal device offset from the symmetric position as shown by position B in FIG. 7B.

Figure 5C:
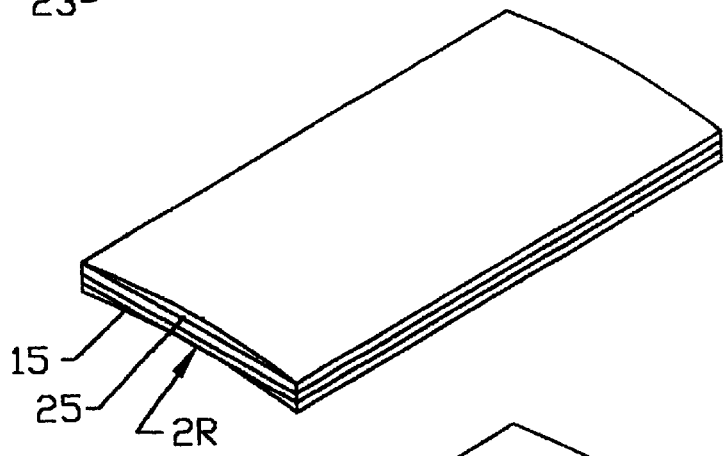
FIG. 5C shows a cylindrically curved crystal lamella with atomic planes 25 tangent to the surface of the lamella 15 along a midline.
Figure 5D:
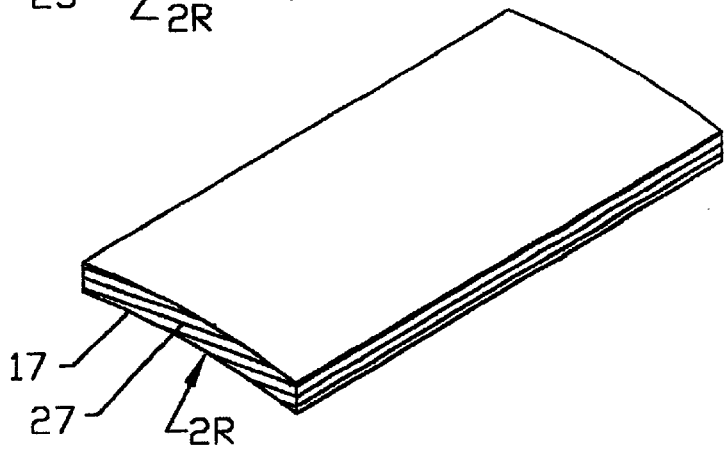
FIG. 5D shows a cylindrically curved crystal lamella with atomic planes 27 making an angle to the surface of the lamella 17.
Figure 6C:
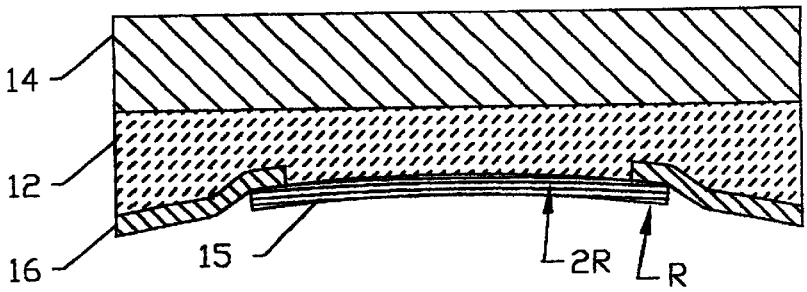
FIG. 6C shows a vertical cross section of a doubly curved crystal device made by using the crystal lamella of FIG. 5C.
Figure 6D:
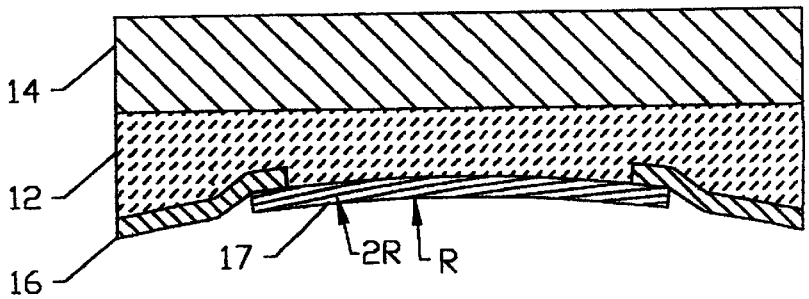
FIG. 6D shows a vertical cross section of a doubly curved crystal device made by using the crystal lamella of FIG. 5D.

Two different Johansson geometries are obtained if the crystal slab is curved to a radius $2R_1$ as shown in FIG. 5C and FIG. 5D. Like their 2-dimensional analog, Johansson-based point-to-point focussing devices will provide greater solid angle of collection and also more exact focussing than Johann-based devices. They are particularly advantageous when used with crystals having a small rocking curve width. When the crystal planes 25 are parallel to the surface 15 of the crystal at its mid-line as shown in FIG. 5C, the result after bending to a mold with radius $R_1$ is shown in FIG. 6C. This crystal device when aligned with respect to source s and image I will be in the symmetric position c shown in FIG. 7C. But if the crystal planes 27 make an angle with respect to the surface 17 as shown in FIG. 5D, the result after bending to a mold with radius $R_1$ would be as shown in FIG. 6D. Then, when the crystal device is properly aligned, it will be asymmetric relative to S and I, as shown by position D in FIG. 7C.

The alignment of the crystal devices relative to the Source S and Image I can be accomplished by a device similar to one described in U.S. patent application Ser. No. 09/149,690 (now U.S. Pat. No. . . . ) which is hereby incorporated by reference. For this purpose, it is important to have indexing features on the crystal device so that its position relative to the source and image can be roughly preset and also only adjustments that are absolutely necessary need to be accommodated. The initial positioning is facilitated by the mounting fixture 50 of FIG. 7A having a U shape with the space between the arms of the U configured to match the backing plate. The backing plate with crystal is attached to fixture 50 by screw 33 like it had been previously attached to the piston. A leaf spring 47 maintains contact of surface 38 of the backing plate with surface 39 of 50 before 33 is fully tightened and contact of surface 40 of the backing plate and 41' of 50 is maintained when 33 is fully tightened. Thus, the position of the crystal is now fixed relative to the fixture 50, as it was previously fixed relative to the mold 20. Details of the degrees of freedom for which adjustments might be provided as well as a simple mechanism for adjustment of the others are given in the reference cited.

Figure 7B:
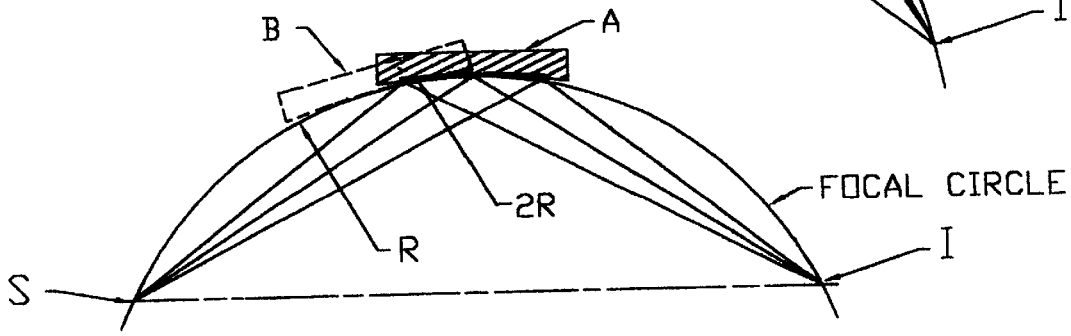
FIG. 7B shows a cross section of a toroidal crystal device with point-to-point focusing based on the Johann geometry.
Figure 7C:
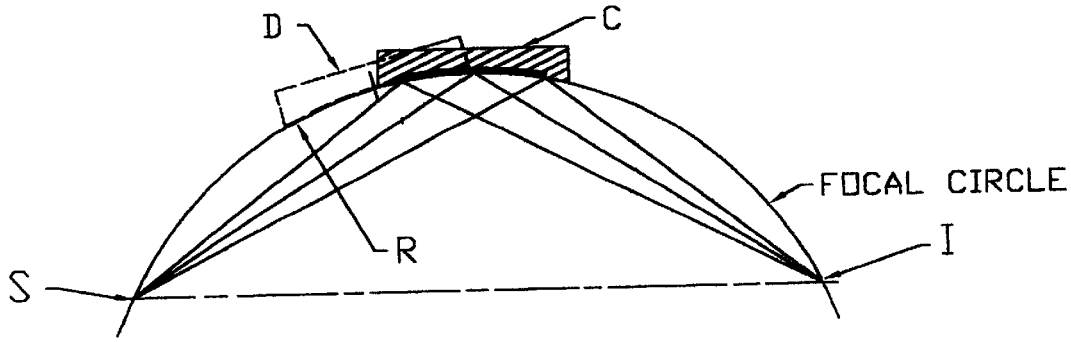
FIG. 7C shows a cross section of a toroidal crystal device with point-to-point focusing based on the Johansson geometry.

While the asymmetric cases shown in FIGS. 7B and 7D show the crystal device closer to the source than to the image, clearly the opposite situation case could be achieved (i.e. crystal device closer to the image than to the source). The asymmetric cases are sometimes useful to provide additional space in the x-ray source region or image region.

DISCUSSION AND RAMIFICATIONS

An x-ray crystal device according to this invention provides a doubly bent crystal that accurately conforms to a theoretically optimum shape and provides better performance than similar crystal devices made according to the prior art. Moreover, the methods of fabrication allow for the production of many identical crystal devices from the same mold, thus reducing the cost of the each device.

The first monochromatic x-ray microprobe that had sufficient intensity for trace element determination in x-ray fluorescence analysis and was based on a laboratory source was developed using an x-ray crystal device similar to the one described herein (re: papers by Z. W. Chen and D. B. Wittry, "Monochromatic microprobe x-ray fluorescence— . . . J. Appl. Phys. vol. 84, pp. 1064–73, 1998, and "Microprobe x-ray fluorescence . . . Appl. Phys. Lett. vol. 71, 1997, pp. 1884–6). The device used in the cited work was based on a Johann geometry with focal circle radius of about 125 mm with a mica crystal having an effective area of approximately 8 mm×28 mm and produced an x-ray spot size of about 50 $\mu$m with an x-ray source of about 20 g $\mu$m.

An indication of the advantages of some of the features of the present invention can be obtained by comparing the theoretical performance of some examples of specific crystal devices with the Johann-based mica diffractor used by Chen and Wittry. If a silicon (111) crystal were used and the values of the rocking curve width of $8.7\times10^{-5}$ radian (instead of $30\times10^{-5}$) and peak reflectivity of 0.7 (instead of 0.2) are assumed, then, with the Johann-based geometry, the broadening of the focal spot due to the crystals rocking curve would be about 8.7 $\mu$m instead of 30 $\mu$m as it was for the mica crystal. The effective crystal width would be $8\times(8.7/30)^{0.5}=4.31$ mm for the Johann-based geometry—but we must note that for copper K alpha radiation and Si crystal, the penetration of the rays into the crystal is sufficient that there would be little distinction between this geometry and the Johansson geometry. This distinction becomes more evident if we consider wider crystals, for example 16 mm.

The peak reflectivity for the Si crystal is about 3.5 times higher than that of mica, so, if equal widths are considered, the total flux of the focused probe could be the same if the Gaussian image size were smaller by $\sim(1/3.5)^{0.5}=(1/1.87)$ yielding a spot size of $(20/1.87)+8.7=19.4$ $\mu$m vs $(20+30)=50$ $\mu$m. But, if a Johansson-based crystal were used having a width of 16 mm the corresponding Gaussian image would be 7.6 $\mu$m, yielding a spot size of $7.6+8.7=16.3$ $\mu$m and then the number of photons/sec/cm$^2$ would be greater than that which was obtained with mica by a factor of approximately $(50/16)^2=9.76$.

In order to make smaller spots, it is important to reduce the broadening due to the rocking curve width. But as this gets smaller, it is no longer possible to utilize all of the characteristic line's natural width. The intensity loss resulting from focusing only part of the characteristic line can be estimated as follows: Bragg's law is: $n\lambda=2d\sin\theta$ where $\theta$ is the Bragg angle. Differentiating Bragg's law on both sides and dividing by Bragg's law, we obtain:

$$(\Delta\lambda/\theta)_B=(1/\tan\theta)\Delta\theta$$

where $\Delta\Theta$ is the rocking curve width. Assuming that the characteristic line has $(\Delta\lambda/\lambda)_L=2\times10^{-4}$ and assuming values for Cu K radiation and the (111) reflection from silicon, we obtain:

$$(\Delta\lambda/\lambda)_B/(\Delta\lambda/\lambda)_L=8.7\times10^{-5}/(\tan 14.21)\times2\times10^{-4}=1/1.71$$

Thus the rocking curve width for the Si (111) crystal would appear to be reasonably well matched to focus nearly all the characteristic X-ray line.

One can calculate similarly the results of using a crystal with even narrower rocking curve width e.g. $\alpha$ quartz (2243) with a rocking curve of about $5\times10^{-6}$ radian. This would yield image broadening due to the rocking curve width of only about 0.5 $\mu$m. Then, the loss of intensity due to not using all of the natural line width is more serious. For this case and copper K radiation we would obtain:

$$(\Delta2/\lambda/\lambda)_s/(\Delta\lambda/\lambda)_L=5\times10^{-6}/(\tan 49.64)\times2\times10^{-4}=1/46.8$$

In order to offset this effect, it is clearly desirable to use the Johansson-based geometry and wider crystals. Also one should use higher voltage for the x-ray source since the intensity of characteristic lines increases as the 1.63 power of the voltage above the critical excitation voltage (for copper K radiation this would be approximately 3× if 50 kV instead of 30 kV were used). For this case the total number of photons/sec in a 10 $\mu$m spot formed by the quartz crystal would be lower than that obtained in a 16 $\mu$m spot with a Si crystal by a factor of $(9.5/7.6)^2\times(3/46)$ 0.1.

Thus, by using all available techniques, it should be possible to obtain focal spot sizes significantly less than 10 $\mu$m with adequate intensity for x-ray fluorescence analysis, although the detection limits would be lower than those obtained for larger spot sizes. Note that in our calculations we have assumed for simplicity that the number of photons/sec in the Gaussian image is proportional to the square of its diameter, which would be the case for an aperture of fixed size in the electron beam forming the x-ray source. It is well known that if the aperture size is optimized, the current on a spot of diameter d is proportional to $d^{8/3}$.

We should also note that while it might appear that rocking curves as small as $5\times10^{-6}$ would make it seem hopeless to align a doubly curved diffractor properly, the natural width of the characteristic x-ray line would in fact allow such an alignment to be done. In any case, it is important that it be possible to preset the position and orientation of the crystal device to as high a degree as possible—otherwise obtaining proper alignment not only requires a costly alignment fixture, but could be like looking for the proverbial "needle in a haystack".

The features of the present invention including the possibility of fabricating Johansson-based doubly curved crystal devices and prepositioning them relative to a source and image position are vitally important for future developments in x-ray microprobe technology.

I claim:

1. A curved crystal x-ray optical device comprising the following elements listed in the order in which they are located in said device:

a lamella of crystalline material having atomic planes doubly curved with a radius of curvature of $2R_1$ in a first plane and $R_2$ in a second plane perpendicular to the first plane wherein an arc of radius $R_1$ in said first plane defines a focal circle of radius $R_1$, with the said crystal lamella having a thickness no greater than about 1/5000 of the smallest radius of curvature and the concave side of said lamella faces outward, a thin plastic sheet having a thickness of about 0.025–0.1 mm covering a portion of the convex side of said crystal lamella and extending beyond its edges for a distance of 1–3 mm, a thick bonding layer having a thickness of 10 to 50 times the thickness of the lamella, a backing plate to which said lamella is attached by said bonding layer, said backing plate having an exterior planar indexing surface whereby the position in a first direction and the orientation in two angles for said lamella are preset relative to a mounting fixture in which said device is used, said mounting fixture having a mating surface for said indexing surface, said direction lying along a line substantially parallel to the large surface of the lamella, said line lying in a plane passing through the center of the lamella and an x-ray source.

2. A curved crystal device as described in claim 1 wherein the thick bonding layer is an epoxy resin.

3. A curved crystal device as described in claim 1 wherein the thick bonding layer is a thermoplastic resin.

4. A curved crystal device as described in claim 1 wherein said backing plate contains a second exterior planar indexing surface at right angles to the first planar indexing surface and also contains a third planar indexing surface hereinafter called the inclined plane which lies at an angle with respect to the said second planar indexing surface whereby the position of said lamella in two directions mutually perpendicular to each other and to said first direction and a third angular orientation of the crystal lamella can be preset relative to said mounting fixture, said mounting fixture now provided with mating surfaces for said second indexing surface and said inclined plane, and a force is applied by the inclined plane on its mating surface by means of a screw, said force pushing the two inclined surfaces together so that they can slide against each other and cause the second indexing surface to be maintained in contact with its mating surface.

5. A curved x-ray optical device as described in claim 1 wherein the concave surface of said crystal lamella is parallel to the atomic planes in the plane of the focal circle so that the Johann geometry is obtained in the plane of the focal circle when the device is used in said mounting fixture.

6. A curved crystal x-ray optical device as described in claim 1 wherein said crystal lamella has its concave surface curved with a radius $R_1$ in the plane of the focal circle so that the Johansson geometry is obtained in the plane of the focal circle when the device is used in said mounting fixture.

7. A curved crystal x-ray optical device as described in claim 1 wherein $R_2=2R_1$ for the said crystal lamella and the concave surfaces of said lamella has a radius of $R_2$ both in the plane of the focal circle and perpendicular to it yielding a simple spherically curved lamella.

8. A curved crystal x-ray optical device as described in claim 1 wherein $R_2=2R_1$ for the said crystal lamella and the concave surface of said lamella has a radius of $R_1$ in the plane of the focal circle and $2R_1$ in the plane perpendicular to it yielding the so-called Wittry geometry.

9. A curved crystal x-ray optical device comprising the following elements listed in the order in which they are located in said device:

a lamella of crystalline material having atomic planes curved to a toroidal shape with a radius of curvature of $2R_1$ in a first plane and $R_2$in a second plane perpendicular to the first plane wherein an arc of radius $R_1$ in said first plane defines a focal circle of radius $R_1$, with the said crystal lamella having a thickness no greater than about 1/5000 of the smallest radius of curvature and the concave side of said lamella faces outward, a thick bonding layer having a thickness of 10 to 50 times the thickness of the lamella, a backing plate to which said lamella is attached by said bonding layer, said backing plate having an exterior planar indexing surface whereby the position in a first direction and the orientation in two angles for said lamella are preset relative to a mounting fixture in which said device is used, said mounting fixture having a mating surface for said indexing surface, said direction lying along a line substantially parallel to the large surface of the lamella, said line lying in a plane passing through the center of the lamella and an x-ray source.

10. A curved crystal device as described in claim 9 wherein the thick bonding layer is an epoxy resin.

11. A curved crystal device as described in claim 9 wherein the thick bonding layer is a thermoplastic resin.

12. A curved crystal device as described in claim 9 wherein said backing plate contains a second exterior planar indexing surface at right angles to the first planar indexing surface and also contains a third planar indexing surface hereinafter called the inclined plane which lies at an angle with respect to the said second planar indexing surface whereby the position of said lamella in two directions mutually perpendicular to each other and to said first direction and a third angular orientation of the crystal lamella can be preset relative to said mounting fixture, said mounting fixture now provided with mating surfaces for said second indexing surface and said inclined plane, and a force is applied by the inclined plane on its mating surface by means of a screw, said force pushing the two inclined surfaces together so that they can slide against each other and cause the second indexing surface to be maintained in contact with its mating surface.

13. A curved x-ray optical device as described in claim 9 wherein the concave surface of said lamella is parallel to the atomic planes in the plane of the focal circle so that the Johann geometry is obtained in the plane of the focal circle.

14. A curved crystal x-ray optical device as described in claim 9 wherein said crystal lamella has its concave surface curved with a radius $R_1$ in the plane of the focal circle so that the Johansson geometry is obtained in the plane of the focal circle.

15. A curved crystal x-ray optical device as described in claim 9 wherein $R_2=2R_1$ for the said crystal lamella and the concave surface of said lamella has a radius of $R_2$both in the plane of the focal circle and perpendicular to it yielding a simple spherically curved lamella.

16. A curved crystal x-ray optical device as described in claim 9 wherein $R_2=2R_1$ for the said crystal lamella and the concave surface of said lamella has a radius of $R_1$ in the plane of the focal circle and $R_1$ in the plane perpendicular to it, yielding the so-called Wittry geometry.

17. A method of fabricating a doubly curved x-ray optical device comprising the following steps:

a) preparing a suitable doubly curved convex mold having a radius of curvature $2R_1$ in a first plane and $R_2$ in a second plane orthogonal to the first plane, b) preparing a suitable crystal lamella, c) preparing a piece or pieces of thin plastic sheet having a thickness of approximately 0.025–1 mm., d) preparing a suitable pressing fixture attached to said mold and comprising a rectangular piston and a rectangular cavity in which said piston is free to translate, a screw that moves said piston inside said rectangular cavity, and a knob to turn said screw, e) preparing a suitable backing plate, said backing plate having orthogonal surfaces as needed for indexing the position of the backing plate relative to said piston in said pressing fixture, f) affixing said backing plate to said piston, g) positioning, fitting or covering a portion of the convex side of the crystal lamella with the claimed thin plastic sheet such that said sheet extends beyond the edges of the lamella a predetermined distance, h) assembling said convex mold, with said crystal lamella, a blob of bonding material, said backing plate and said piston inside said pressing fixture in this order, i) allowing initial setting of the bonding material, j) turning said screw with said knob to compress bonding material until said crystal is in intimate contact with said mold, k) allowing bonding material to reach its final hardened state, l) removing the bonded assembly from the said pressing fixture said mold, and said piston.

18. A method for fabricating a curved crystal x-ray optical device as described in claim 17 wherein said crystal lamella in step (b) contains two semi-circular indentations along opposite edges, and said mold in step (a) contains two spring-loaded dowel pins, said pins engaging said indentations for the purpose of orienting said crystal lamella with said mold.

19. A method for fabricating a curved crystal x-ray optical device as described in claim 17 wherein said crystal lamella in step (b) is a flat lamella with surfaces parallel to the atomic planes.

20. A method for fabricating a curved crystal x-ray optical device as described in claim 17 wherein said crystal lamella in step (b) is a flat lamella with surfaces making an angle with respect to the atomic planes.

21. A method for fabricating a curved crystal x-ray optical device as described in claim 17 wherein said crystal lamella in step (b) is a cylindrically curved lamella with surfaces parallel to the atomic planes along a midline, said cylindrically curved lamella having a radius of curvature of $2R_1$.

22. A method for fabricating a curved crystal x-ray optical device as described in claim 17 wherein said crystal lamella is a cylindrically curved lamella with surfaces making an angle with respect to the atomic planes along a midline, said cylindrically curved lamella having a radius of curvature of $2R_1$.

23. A method for fabricating a curved crystal x-ray optical device as described in claim 17 wherein said blob of bonding material in step (g) consists of an epoxy resin.

24. A method for fabricating a curved crystal x-ray optical device as described in claim 17 wherein said blob of bonding material in step (g) consists of a thermoplastic resin.

25. A method for fabricating a curved crystal x-ray optical device as described in claim 17 wherein said blob of bonding material in step (g) consists of a wax.

* * * * *